US010850205B2

(12) United States Patent
Forgrave et al.

(10) Patent No.: US 10,850,205 B2
(45) Date of Patent: Dec. 1, 2020

(54) MARBLE TRACK PIECE WITH TRIGGERED LIGHT AND/OR SOUND

(71) Applicant: Global Family Brands, LLC, Indianapolis, IN (US)

(72) Inventors: Jeffrey Forgrave, Indianapolis, IN (US); Chris Suen, Kowloon (HK)

(73) Assignee: Global Family Brands, LLC, Indianapolis, IN (US)

( * ) Notice: Subject to any disclaimer, the term of this patent is extended or adjusted under 35 U.S.C. 154(b) by 0 days.

(21) Appl. No.: 16/522,252

(22) Filed: Jul. 25, 2019

(65) Prior Publication Data

US 2020/0054954 A1 Feb. 20, 2020

Related U.S. Application Data

(60) Provisional application No. 62/703,232, filed on Jul. 25, 2018.

(51) Int. Cl.

| | |
|---|---|
| ***A63H 33/22*** | (2006.01) |
| ***A63H 18/02*** | (2006.01) |
| ***A63H 33/08*** | (2006.01) |
| ***A63H 33/26*** | (2006.01) |

(52) U.S. Cl.

CPC ..... *A63H 18/025* (2013.01); *A63H 33/08* (2013.01); *A63H 33/22* (2013.01); *A63H 33/26* (2013.01)

(58) Field of Classification Search

CPC ..... A63H 18/00; A63H 18/02; A63H 18/023; A63H 18/025; A63H 18/04; A63H 3/006; A63H 3/28; A63H 33/042; A63H 33/22

USPC ..... 446/168, 175, 219, 484

See application file for complete search history.

(56) References Cited

U.S. PATENT DOCUMENTS

| | | | | |
|---|---|---|---|---|
| 4,230,317 | A * | 10/1980 | Breslow | A63F 7/0058 200/61.01 |
| 6,179,686 | B1 * | 1/2001 | Ogawa | A63H 18/00 446/429 |
| 6,443,796 | B1 * | 9/2002 | Shackelford | A63H 33/042 273/237 |
| 2013/0045656 | A1 * | 2/2013 | Aigner | A63H 19/24 446/175 |
| 2016/0136534 | A1 * | 5/2016 | Earl-Ocran | A63H 30/04 446/175 |

* cited by examiner

*Primary Examiner* — Kien T Nguyen

(74) *Attorney, Agent, or Firm* — Maginot, Moore & Beck LLP

(57) ABSTRACT

A triggered marble run module is intended for use with a plurality of physically interconnectable marble run modules. Each module retains a marble and guides the travel of the marble through the module on at least a first surface. The triggered marble run module includes a marble travel path, a marble actuated switch and an output circuit. The marble actuated switch has first and second terminals and is operably coupled to close a circuit between the first terminal and second terminal through the first terminal and the second terminal responsive to actuation by a marble traveling in proximity of the marble actuated switch. The output circuit generates at least one of a group consisting of an audio output, a visual output, and an RF signal output, responsive to formation of the closed circuit between the first terminal and the second terminal through the first and second spring elements.

20 Claims, 9 Drawing Sheets

MARBLE TRACK PIECE WITH TRIGGERED LIGHT AND/OR SOUND

This application claims the benefit of U.S. Provisional Patent Application Ser. No. 62/703,232, filed Jul. 25, 2018, which is incorporated herein by reference in its entirety.

FIELD OF THE INVENTION

The present invention is related to building toys, and more specifically, kits for designing and building marble run tracks.

BACKGROUND

Marble run toys known in the art have interconnecting track sections that may be arranged by a user in any of a plurality of designs. Once constructed, the track can define a downhill track through the various sections or modules. The interchangeable nature of the various module designs allow for the construction of many different marble run layouts.

FIG. 1 shows an exemplary marble run layout 10 formed of a plurality of interconnecting modules 11A, 11B, 11C, 11D, 11E, 11F and 18. The modules may take many forms, such as modules 11A, 11B and 11C, which include channels 12 that laterally direct a marble from a vertical receiving tube 14 to an exit tube 16. The channels 12 may define circuitous routes, such as those modules 11B and 11C. Other modules are merely vertical tubes 18 that can be used as part of the track, or merely as vertical support structures for other modules. Still other modules 11D can include a wide platform 20 with spikes 22 to direct the ball in an unpredictable path from the vertical receiving tube 24 and the exit tube 26. Other modules 11E can include a bowl structure. Other modules having additional or alternative features are known.

In popular marble run kits, the vertical receiving tube 14 of each module is generally designed to directly physically connect to an exit tube 16 of an upstream module, thus allowing the marble to transition from module to module. In FIG. 1, most of the receiving tubes 14 are disposed within part of the exit tube 16 of an upstream module, and therefore is not in view. The modules may have other tubes or structures 28 under the vertical receiving tube 14 to allow that portion of the module to be supported from below, for example, by vertical tube modules. Similarly, the modules may have a bypass tube 30 disposed vertically above the exit tube 16 that may provide support as well as an alternative input.

Like many construction toys, the marble run kits currently available allow for creative play by enabling the user to construct the marble run (or multiple runs) in a multitude of configurations. Unlike many construction toys, however, the marble run kits have the added advantage providing an animated feedback of the player's design via movement of the marble. Accordingly, marble run kits have enjoyed pervasive success.

It would be advantageous to create a toy kit that builds on the advantages of the marble run kits with additional interactive feedback while preserving the appealing aspects of the original design.

SUMMARY

At least one embodiment described herein contemplates a marble track piece that includes a marble-actuatable switching element, a lamp and/or speaker, and a drive circuit configured to cause the lamp to light and/or the speaker to emit sound, and a power source. Such an embodiment allows for the user to design the marble run, that includes visual and/or audible effects. In some embodiments, the effects may be controlled via wireless operation, for example, using infrared or Bluetooth transmission.

In a first embodiment, a triggered marble run module is intended for use with a plurality of physically interconnectable marble run modules. Each module retains a marble and guides the travel of the marble through the module on at least a first surface. The triggered marble run module includes a marble travel path, a marble actuated switch and an output circuit. The marble actuated switch has first and second terminals and is operably coupled to close a circuit between the first terminal and second terminal through the first terminal and the second terminal responsive to actuation by a marble traveling in proximity of the marble actuated switch. The output circuit generates at least one of a group consisting of an audio output, a visual output, and an RF signal output, responsive to formation of the closed circuit between the first terminal and the second terminal through the first and second spring elements.

In a second embodiment, a triggered marble run module is also intended for use with a plurality of physically interconnectable marble run modules. Each module retains a marble and guides the travel of the marble through the module on at least a first surface. The triggered marble run module includes a marble travel path and a switch. The switch has an actuator disposed at least in part in the marble path, a conductive first spring element electrically coupled to a first terminal, and a conductive second spring element electrically coupled to a second terminal. The first spring element has a first bias in which the first spring element and the second spring element form an open circuit between the first terminal and the second terminal. The actuator is operably coupled to cause the first spring element to overcome the first bias and form a closed circuit between the first terminal and the second terminal through the first and second spring elements.

The above-described features and advantages, as well as others, will become more readily apparent to those of ordinary skill in the art by reference to the following detailed description and accompanying drawings.

DETAILED DESCRIPTION

Figure 1:
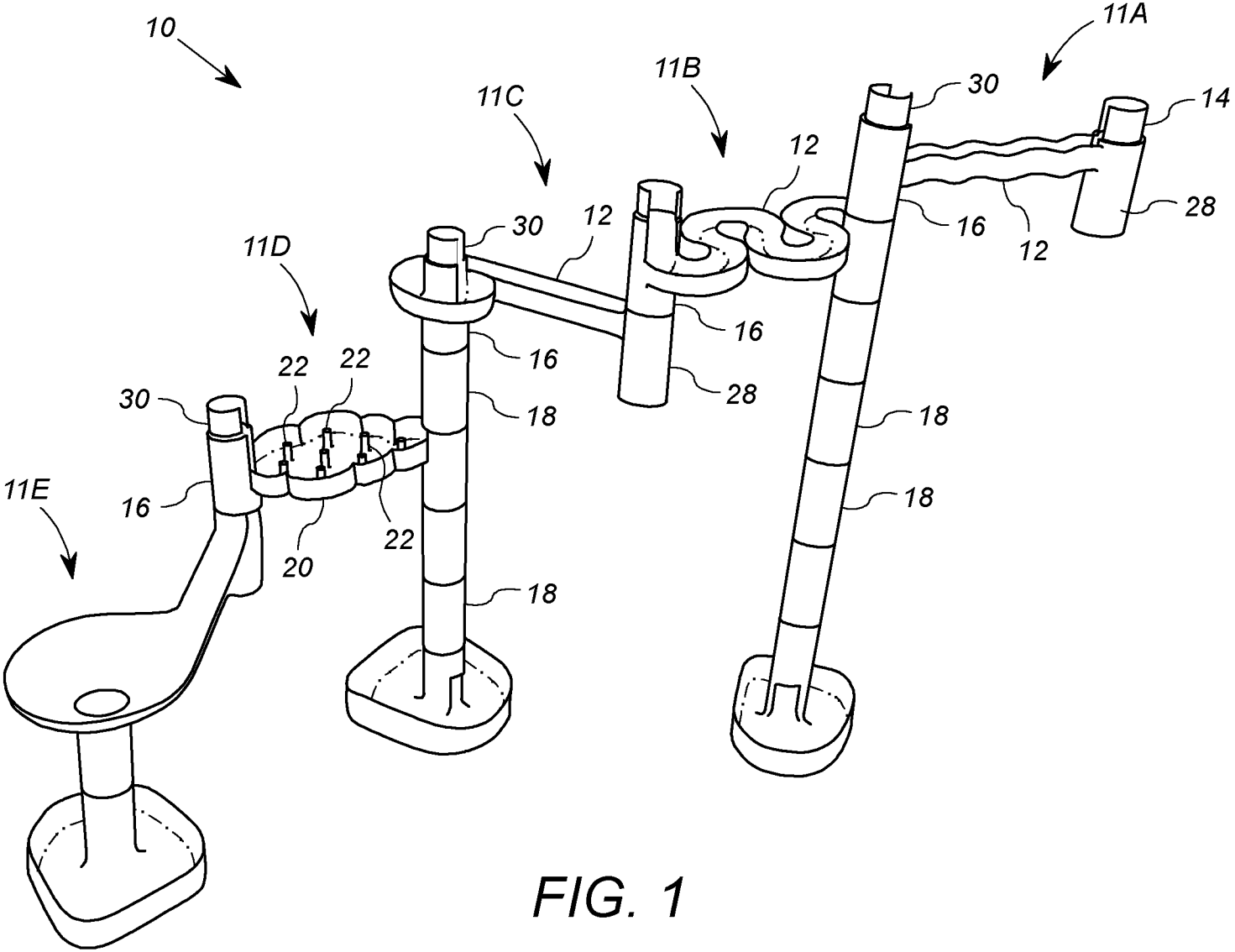
FIG. 1 shows a perspective view of an exemplary marble run formed from at least part of a prior art marble run kit.

An exemplary embodiment of the invention is a marble run kit that includes a plurality of physically interconnectable marble run modules. Each module is configured to retain a marble and guide the travel of the marble through the module on at least a first surface. One or more of the marble modules is a module that generates a light display or an audible display responsive to actuation of a switch disposed on the first surface by contact with a marble. The other marble modules may suitably be traditional passive modules, for example, such as those shown in FIG. 1. However, it will be appreciated that the other modules may have designs that differ from those shown in FIG. 1.

Figure 2:
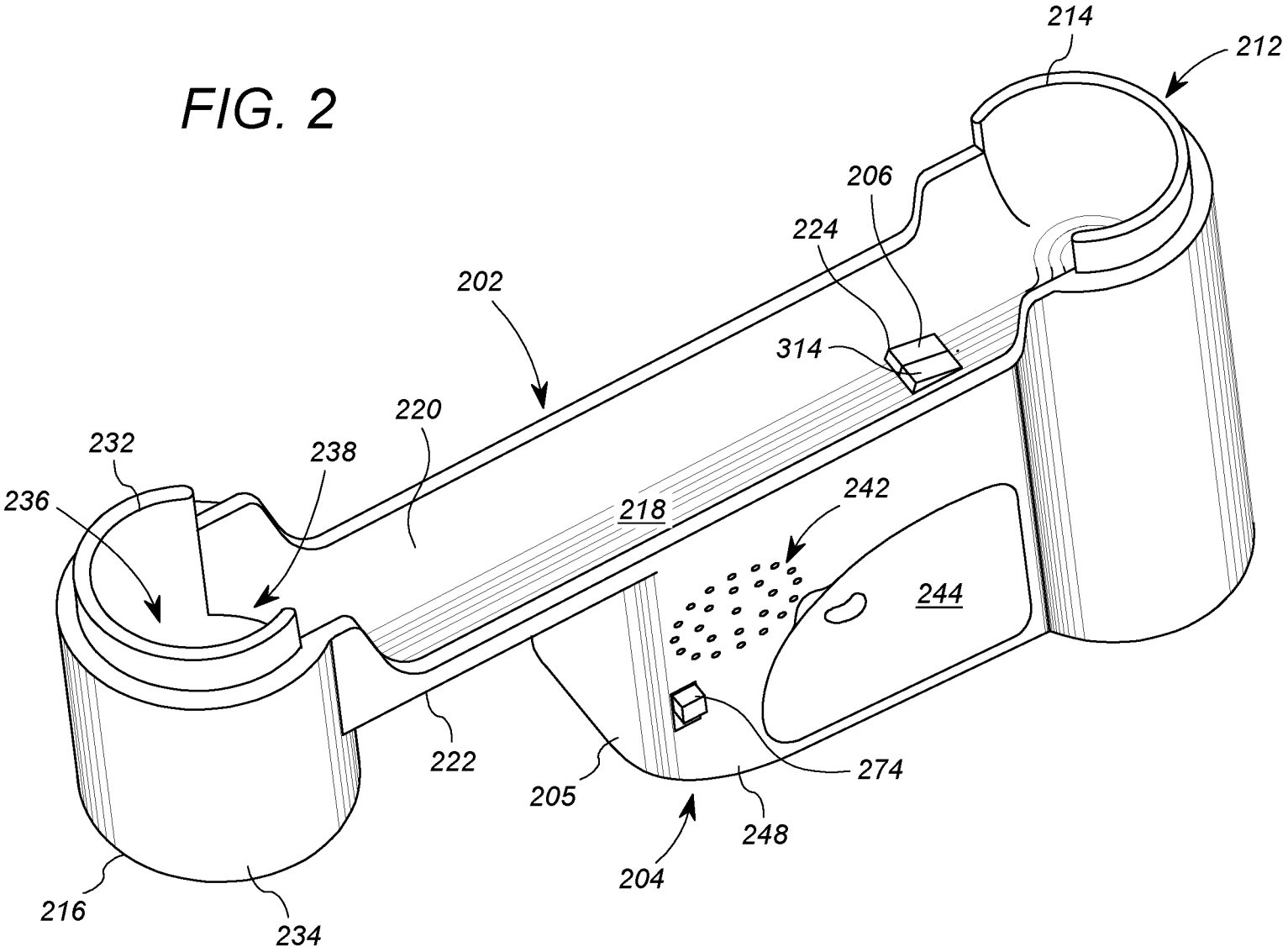
FIG. 2 shows a first perspective view of an exemplary marble track module that may be employed in a marble run kit that also includes one or more modules shown in FIG. 1.
Figure 3:
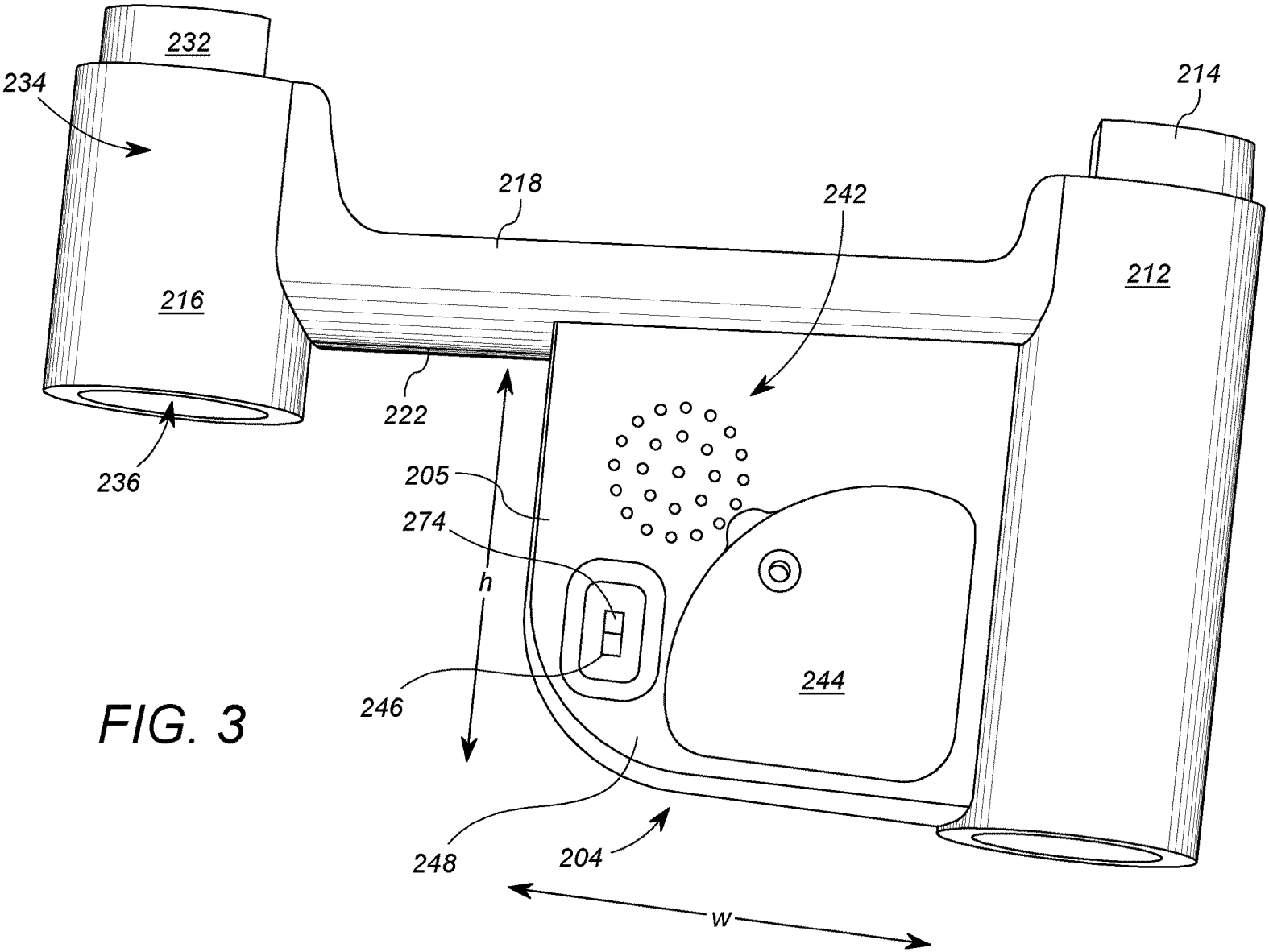
FIG. 3 shows a second perspective view of the marble track module of FIG. 2.

FIGS. 2 and 3 illustrate a first embodiment of an audio/visual marble track ("A/V") module 200 that may be used in a marble run kit according to the present invention. The A/V module 200 includes a triggering arrangement that causes an A/V display responsive to a marble actuating the triggering mechanism.

To this end, the A/V module 200 includes an interconnectable track base 202, an output circuit 204 (see FIGS. 5 and 6), an assembly housing 205 and a marble actuated switch 206. The track base 202 includes a vertical receiving tube 212, an exit tube 216, and a travel region 218. The vertical receiving tube 212 includes a connecting portion 214 configured to directly physically connect to a corresponding exit tube of an upstream module. For example, the connecting portion 214 may suitably connect to any of the exit tubes 16 of FIG. 1. The vertical receiving tube 212 is configured to receive a suitable marble from the corresponding exit tube of the upstream module. The exit tube 216 of the module 200 is configured to directly physically connect to a corresponding vertical receiving tube of a downstream module. For example, the exit tube 216 is configured to connect to vertical receiving tube 14 of any of the modules 11 of FIG. 1.

The travel region 218 is in this embodiment a sloped, lateral, u-shaped marble channel configured to receive and guide a corresponding, suitable marble. A marble channel, as used herein, is a channel having a cross-sectional size and shape sufficient to retain a marble therein while a marble travels through the channel. The u-shaped marble channel of the travel region 218 has a cross-sectional diameter that is less than twice the diameter of a marble intended for use with the kit. In general, the marble channel of the travel region 218 includes a marble receiving surface 220 and an opposite bottom surface 222. The travel region 218 is configured to retain and guide the marble from the vertical receiving tube 212 to the exit tube 216. The receiving surface 220 of the channel slopes downward from the receiving tube 212 to the exit tube 216 to allow the marble to advance at least in part via gravity. The travel region 218 and receiving surface 220 in this embodiment extend into and/or under the vertical receiving tube 212 to catch the marble falling into the receiving tube 212 and direct the marble down the travel region 218.

The marble actuated switch 206 is a spring biased contact switch disposed in and through an opening 224 in the marble receiving surface 220. The marble actuated switch 206 has a first and a second position. FIG. 2 shows the switch 206 in a first position, in which at least a portion of the switch 206 (actuator button 314, discussed further below) stands proud of the marble receiving surface 220. In the second position, not shown, the switch 206 is depressed such that its upper most surface is approximately flush with the adjacent portion of the marble receiving surface 220. As will be discussed below in detail, the switch 206 is spring biased towards the first position, but is configured to depress to the second position responsive to the weight of a standard toy marble, not shown. Thus, when a marble rolls over the switch 206, it transitions the switch 206 from the first position to the second position. As will be discussed below, the transition of the switch 206 from the first position to the second position triggers an audio visual display. However, it will be appreciated that switch 206 may alternative be used to trigger transmission of an RF signal to cause an action somewhere away from the module 206.

The track base 202 also includes a second vertical receiving tube 232 disposed above the exit tube 216, which allows for an alternative travel path of the marble. The second vertical receiving tube 232 is configured to attach to a corresponding exit tube of another module, such as any of the modules 11A, 11B, 11C, 11D, 11E or 18 of FIG. 1. The exit tube 216 and the second vertical receiving tube 232 form a continuous vertical tube 234 having an interior 236. The continuous vertical tube 234 includes a side opening 238 through which a marble may travel from the receiving surface 220 of the travel region 218 to the interior 236 of the tube 234, and thus through the exit tube 216. When the second vertical receiving tube 232 is connected to an exit tube of another module, a marble from such other module may fall straight from the second vertical receiving tube 232 to the exit tube 216 without traversing the travel region 218, and without actuating the switch 206. Thus, the module 200 in this embodiment has alternative marble paths, only one of which triggers the lights and sounds via the switch 206.

The housing 205 is a container that is configured to support the output circuit 204. The output circuit 204 includes an electrical circuit that is configured to generate an audio and visual output. To this end, the output circuit 204 in this embodiment includes electrical circuitry, lights, a speaker and a power source, not shown in FIG. 2 or 3, but is discussed below in connection with FIG. 6. As shown in FIGS. 2 and 3 the housing 205 has a thickness that equal to or less than the width of the travel region 218 and/or the vertical receiving tube 212. The housing 205 has a height h that does not exceed the vertical distance from the bottom 222 of the travel region 218 to the bottom of the vertical receiving tube 212 and a width w that is less than the distance between the vertical receiving tube 212 and the exit tube 216. The housing 205 has a first side 248 and opposing second side 250 (see FIG. 4), each having the height h and the width w. In general, the housing 205 defines an interior, not shown in FIGS. 2 and 3 (see FIGS. 4 and 5), between the two opposing sides 248, 250.

Figure 4:
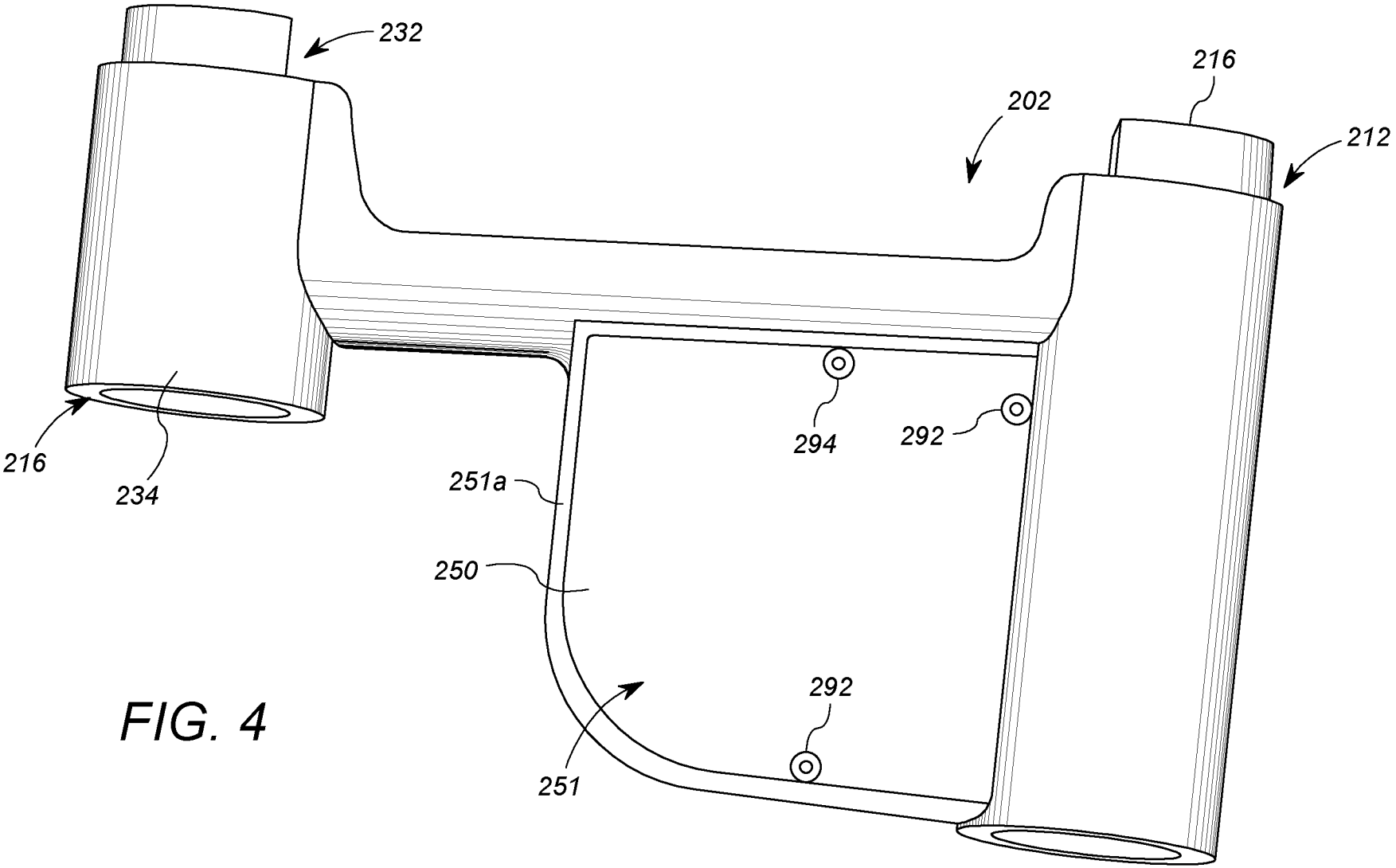
FIG. 4 shows a plan view of the module of FIG. 2 with the electronic assembly and cover removed.

FIG. 4 shows the track base 202 and second side 250 of the housing 205 with the first side 248 and the output circuit 204 removed. As shown in FIG. 4, the second side 250 of the housing 205 is a concave rimmed wall integrally formed with the track base 202. In other embodiments, more or less of the housing 205 may be integrally formed or separately formed and assembled. The rimmed wall (i.e. raised edges) 251*a* defines at least part of the interior 251 of the housing 205. The second side 250 includes a plurality of screw or connection bosses 292 and a first switch boss 294 within the interior 251.

Referring to FIGS. 2, 3 and 4, the first side 248 forms a cover, which in this embodiment also includes a wall with a rim (or raised edges) that align with and attaches to second side 250 to collectively define the interior 251 therebetween. As shown in FIGS. 2 and 3 a first side 248 of the housing 205 may include a speaker grille 242 and access door 244, and a switch opening 246. The speaker grill 242 comprises a group of through-holes that extend from through the first side to the interior 251.

Figure 5:
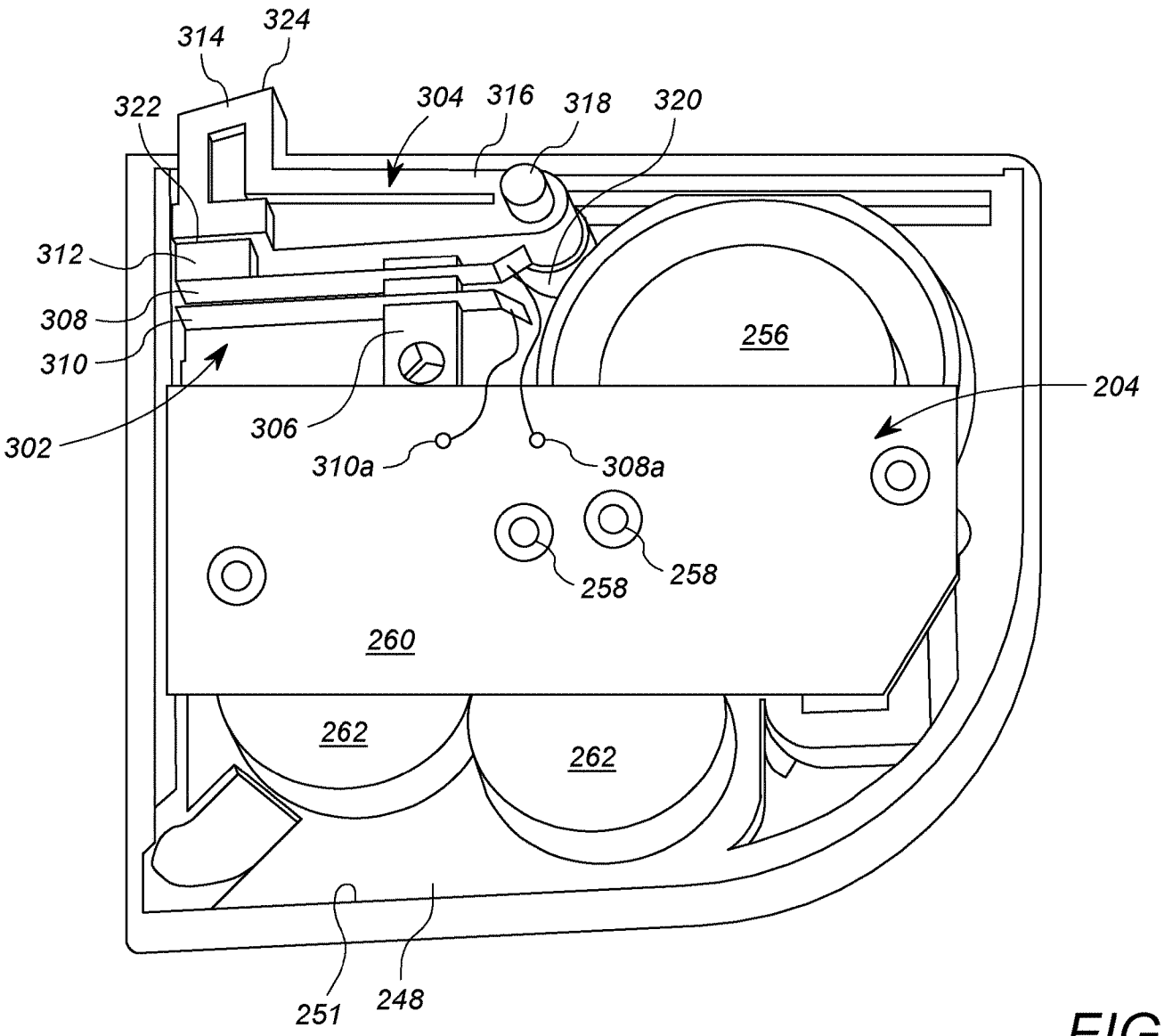
FIG. 5 shows a side plan view of a first side and interior of a housing of the module of FIG. 2 with a second side removed.

FIG. 5 shows perspective view of the first side 248 (or cover) of the housing 205 with the second side 250 removed, revealing the interior 251. Disposed within the interior 251 is the output circuit 204, including a speaker 256, and two indicator lamps 258 in the form of light emitting diodes. With general reference to FIGS. 2-5, the speaker 256 is disposed with its cone adjacent to and facing the speaker grill 242. The light emitting diodes 258 are disposed on a printed circuit board 260 that is mounted or at least supported by the first side 248. It will be appreciated that at least the second side 250 of the housing 240 is formed to be translucent or transparent, such that when the LEDs 258 are activated, light therefrom is visible through the second side 250.

The first side 248 also includes a plurality of battery housings 262 that are configured to receive and fit coin cell batteries. In this embodiment the first side 248 includes three battery housings 262 (not all visible in FIG. 5) and three coin cell batteries, not visible. The battery housings 262 align with the access door 244 such that the batteries are disposed in the interior 251 adjacent to, and accessible by, the access door 244. The access door 244 is preferable secured in closed position by a screw, to avoid inadvertent opening.

The printed circuit board 260 includes various electrical components, as well as conductive traces, not shown, for establishing the electrical connections discussed below in connection with FIG. 6.

The marble actuated switch 206 is shown in FIGS. 2 and 5. The switch 206 includes a spring contact assembly 302 and an actuator assembly 304. The spring contact assembly 302 includes a support pillar 306, a first conductive spring contact 308, a second conductive spring contact 310, and a spacer 312. The actuator assembly 304 is an integrally formed element that includes a sloped button element 314, a rocker arm 316, and first and second axles 318.

The axles 318 extend axially from either side of the rocker arm 316. One of the axles 318 is received and rotatably movable within the boss 294 of the second side 250 shown in FIG. 4. The other axle, not visible in FIG. 5, is received and rotatably movable within a similar boss 320 of the first side 248. The rocker arm 316 can thus move pivotally within the interior 251 about the axles 318. The distal end of the rocker arm 318 has a bottom surface 322 that engages (i.e. contacts) the spacer 312. The sloped button element 314 extends upward from the distal end of the rocker arm 318 and terminates in a sloped surface 324. A portion of the sloped button element 314 extends through the opening 224 of the travel region 218 to expose the sloped surface 324 to marbles on the marble surface 220. (See also FIG. 2). The sloped surface 324 ensures that the movement of the marble is not arrested by the button element 314 while achieving sufficient rotational movement of the rocker arm 316 to cause the contacts 308, 310 to make physical and electrical contact.

The support pillar 306 extends vertically in the interior 251 and secures the first and second contacts 308, 310 in a vertically spaced manner. Each of the spring contacts 308, 310 is an elongate conductive metal spring element that extends in a cantilevered manner from the support pillar 306 in the same lateral direction as the distal end of the rocker arm 316. Each of the spring contacts 308, 310 is electrically connected to, respectively, conductive terminals (or traces) 308*a*, 310*a* of the printed circuit board 260. Thus, when the spring contacts 308, 310 touch at the distal end, such as by operation of the rocker arm 316 (not shown in FIG. 5), the contacts 308, 310 complete an electrical connection between points 308*a* and 310*a*. The spacer 312 is disposed above the top of the spring contact 308.

The contacts 308, 310 are spring biased to be open-circuited, as shown in FIG. 5. The spring bias pushes the spacer 312 upward against the bottom surface 322 of the distal end of the rocker arm 316. That action holds the button element 314 and particular the sloped surface 314 above the marble receiving surface 220 of the travel region 218. When a marble rolls over the button element 314, it forces the rocker arm 316 to rotate counter clockwise or downward. The rocker arm 316 thus pushes against the spacer 312, which in turn deflects the spring contact 308 downward toward the spring contact 310. The sloped surface of the button element 314 causes increased deflection as the marble traverses the surface 220. The spring contact 308 touches the spring contact 310, thereby closing the switch connecting the points 308*a*, 310*a* on the printed circuit board 260. When the marble is clear of the button element 314, the spring bias of the spring element 308 (and 310, if necessary), causes the button element 314, to extend upward again to the resting position shown in FIG. 5.

It will be appreciated that the use of the rocker arm, cantilevered spring elements and the sloped button element 314 allow for the marble to both pass the switch 206 without stopping, and yet generate enough force to close the switch 206.

Figure 6:
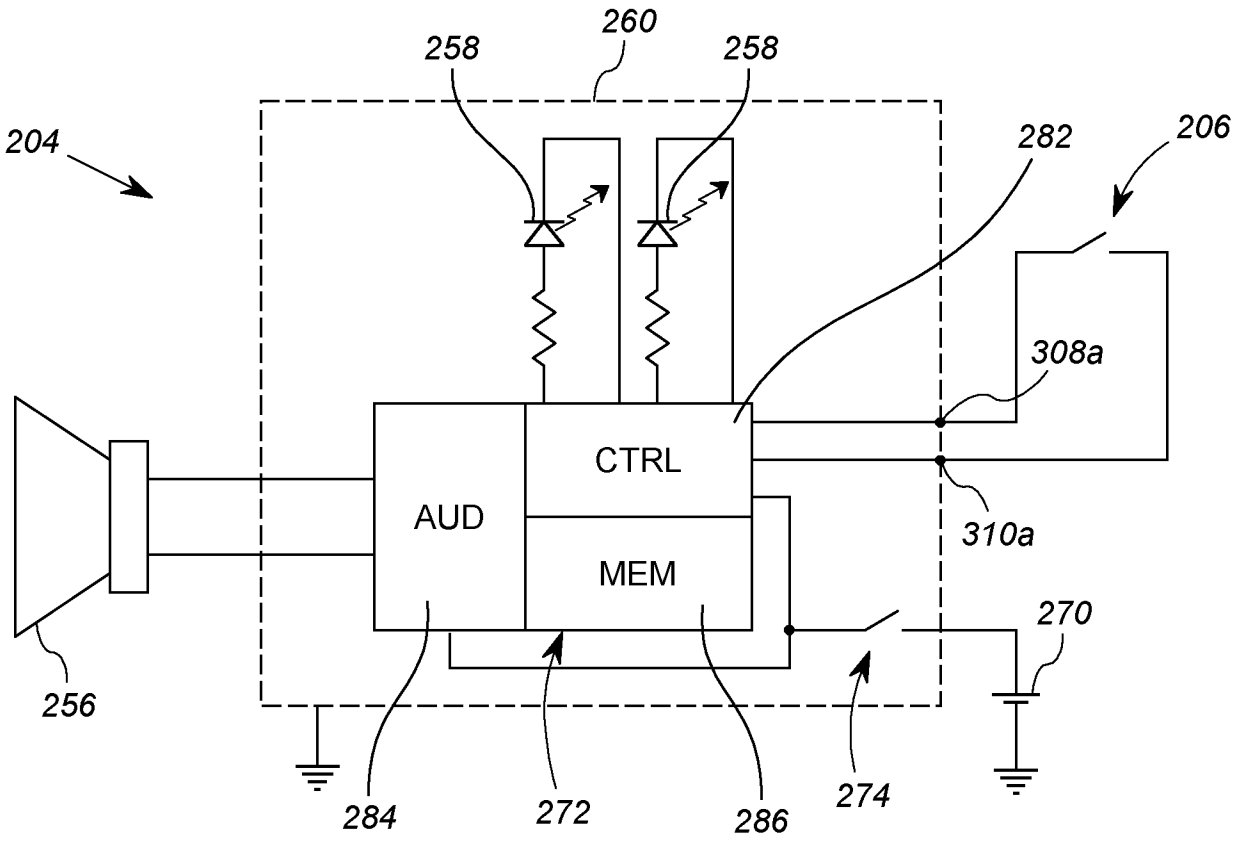
FIG. 6 shows a schematic block diagram of the output circuit of the module of FIG. 2.

FIG. 6 shows a schematic diagram of the output circuit 204, in context with the switch 206, the speaker 256, the LEDs 258, the power source 270. The output circuit 204 includes, the speaker 256, the LEDs 258, the power source 270, an integrated circuit 272 and a switch 274. With reference to FIGS. 2 and 3, the switch 274 may be a two-position slide switch.

The integrated circuit 272, the switch 274, and the LEDs 258 may suitably be mounted on the printed circuit board 260. In this embodiment, the integrated circuit 272 includes a control circuit 282, an audio circuit including an audio synthesizer 284, and a memory 286. It will be appreciated, however, that in other embodiments the audio synthesizer 284, control circuit 282 and memory 286 maybe distributed across multiple integrated or stand-alone circuits. Moreover, it will be appreciated that the printed circuit board will also contain other circuit elements suitable to support the operation of the integrated circuit 272, as would be known in the art.

The memory 286 stores at least one audio signal, and preferably a plurality of audio signal sequences. The plurality of audio signal sequences can be representative of the audio sounds of various animal noises, various noises associated with space travel, and/or weapons, robots, or other groups of sounds associated with a particular kind predetermined subject matter.

The power source 270, which as discussed above is three coin-cell batteries, each 1.5 volts, is connected to the power input of the integrated circuit 272 through the on-off switch 274. The switch 206, as discussed above, is operably connected to close and open the connection between terminals 308*a*, 310*a*, which are also provided directly or indirectly to the integrated circuit 272. As shown in FIG. 5, the terminals 308*a*, 310*a* in this embodiment are located on the circuit board 260, and connected to the spring contacts 208, 210, respectively, by wires. The terminals 308*a*, 310*a* may suitably be in the bias power line or ground connection line of the integrated circuit 272 such that the integrated circuit 272 is only powered when the switch 206 is closed. In such a case, the integrated circuit 272 includes a latch to keep the integrated circuit 272 powered for a short time after the switch 206 opens. Alternatively, the terminals 308*a*, 310*a* may merely connect to a control device that causes the start of operations of the integrated circuit 272.

The audio synthesizer 284 comprises any commercially available device configured to drive the speaker 256 to create audio signals. In some cases, external analog circuit elements may be required to be connected, as would be described by the data sheets of the integrated circuit 272. The audio synthesizer circuitry 284 is preferably configured to sequence through multiple different sound effect patterns that the speaker 256 broadcasts, based on the audio signal sequences stored in the memory 286.

The LEDs 258 are operably coupled to the integrated circuit 272 to be powered (and hence illuminate) in a predefined pattern. To this end, each LED 258 may be separately connected to and driven by the integrated circuit 272. The control circuit 282 is configured to, upon closing of the switch 206, execute a sequence of operations wherein the audio synthesizer 284 drives the speaker to play one of the sound effects, and the LEDs 258 illuminate in a predefined blinking pattern. The lights and sound sequence lasts on the order of a second or less, which ensures that the effect is noticeable, yet does not excessively drain the power source 270.

The control circuit 282 is operably programmed to cause different stored sound effects to play at different occurrences of the switch 206 closing. Specifically, the control circuit 282 is configured to, responsive to the formation of the closed circuit across the terminals 308*a*, 310*a*, cause the audio circuit 284 and speaker 256 to generate the audio output based on in part on a first audio signal sequence of the plurality of audio signal sequences stored in the memory 286. The control circuit 282 is further configured to, responsive to the formation of a subsequent closed circuit across the terminals 308*a*, 310*a*, cause the audio circuit 284 and speaker 256 to generate the audio output based on in part on a second (different) audio signal sequence of the plurality of audio signal sequences stored in the memory 286, and so forth. The control circuit 282 can also be programmed to provide different LED blinking sequences at different occurrences of the switch closing.

It will be appreciated that the output circuit 204 in other embodiments may include different sets of outputs. For example, in some embodiments, the output circuit may only be capable of provide visual output, such as lighting one or more LEDs. In one example, the switch 206 may suitably be connected directly in the power line from the battery to the LEDs. The output circuit 204 may alternatively include a logic circuit and a latch circuit configured to generate a lighting sequence of the LED lights. The output circuit 204 in still other embodiments may include no LEDs, only providing an audio output using the audio synthesizer 284 or any suitable battery-powered audio generator. The output circuit 204 may in other embodiments consist of, or include, an RF transmitter that generates an output RF transmission (or other wireless signal) responsive to the closing of the switch 206. The wireless signal may be received by another device, not shown, but which causes another action responsive to receipt of the wireless signal. In this manner, the marble actuation of the switch 206 may cause an action to take place on an entirely different module, or even some other device.

With contemporaneous reference to FIGS. 1 to 6, the module 200 operates in the following way. In general, the module 200 is connected such that connecting portion 214 of the vertical receiving tube 212 is directly physically connected to a corresponding exit tube of an upstream module, such as any of the exit tubes 16 of FIG. 1. The exit tube 216 of the module 200 is similarly directly physically connected to a corresponding vertical receiving tube of a downstream module, such as the vertical receiving tube 14 of any of the other modules 11 of FIG. 1. The upstream module and downstream module may likewise be connected to other upstream and downstream modules, to form a marble run of any desired design.

The switch 274 in the operation described herein is placed in the closed position, such that the integrated circuit 272 receives electrical power from the power source 270. Although the module 200 may be used as a marble run module with the switch 274 in either the closed or open position, the switch is placed in the closed position to provide power to the integrate circuit 272 to activate the triggered A/V features of the module 200.

In the absence of a marble or any other external force, the actuator 314 of the switch 206 stands proud of the marble receiving surface 220, or in other words is in the first position, as shown in FIG. 2 As shown in FIG. 5, when the button actuator 314 is in the first position, the spring biased contacts 308, 310 are biased such that they do not make electrical contact with each other, and the switch 206 is open as shown in FIG. 6. In steady state (in this embodiment), the control circuit 282 does not cause any sounds or lights.

When a marble exits the exit tube of the upstream module, and enters the vertical receiving tube 212, the marble falls to the marble receiving surface 220 of the travel region 218, and then is urged toward exit tube 216 by gravity and/or momentum. As the marble travels toward the exit tube 216 on the marble receiving surface 220, it engages the button actuator 314. The weight and/or momentum of the marble is translated through the rocker arm 316 and spacer 312 to the spring bias contact 308. The translated force overcomes the spring bias of the contact 308 (the actuator 314 goes into the second "closed" position) such that the contact 308 flexes and electrically contacts the spring biased contact 310, thereby closing the switch 206. When the marble passes by the button actuator, the bias of the spring bias contact 308 causes it to return to the first position shown in FIG. 5. In turn, the spacer 312 drives the rocker arm 316 upward such that the button 314 extends out of the opening 224 again, in the first position, as shown in FIG. 2.

Referring now to FIG. 6, when the switch 206 closes, the control circuit 282 detects the closure and starts a series of operations to create an A/V display. It will be appreciated that in an alternative embodiment, the switch 206 may be serially connected with the switch 274, such that closure of the switch 206 causes completion of the connection between power source 270 and the integrated circuit 272. In such a case, however, a latch circuit, which would be known in the art, would be required to maintain the power connection after the marble exists the switch 206 a sufficient amount of time to allow the control circuit to generate the A/V display. As discussed above, various other audio and/or visual implementations may require different or less circuitry.

In this embodiment, however the control circuit 282 performs a set of operations, responsive to detecting the closure of the switch 206, that create a sequence of lighting of the LEDs 258, and which cause the audio synthesizer 284 and speaker 256 to create an audible output using one of the audio signal sequences stored in the memory 286. The control circuit 282 in this embodiment maintains a counter, wherein each value of the counter corresponds to one of the plurality of audio signal sequences stored in the memory 286. The control circuit 282 causes the audio synthesizer 284 and speaker 256 to create an audible output corresponding to the audio signal sequence corresponding to the current counter value. The control circuit 282 thereafter increments the counter, so that a different sound is made the next time the switch 206 is closed.

Figure 7:
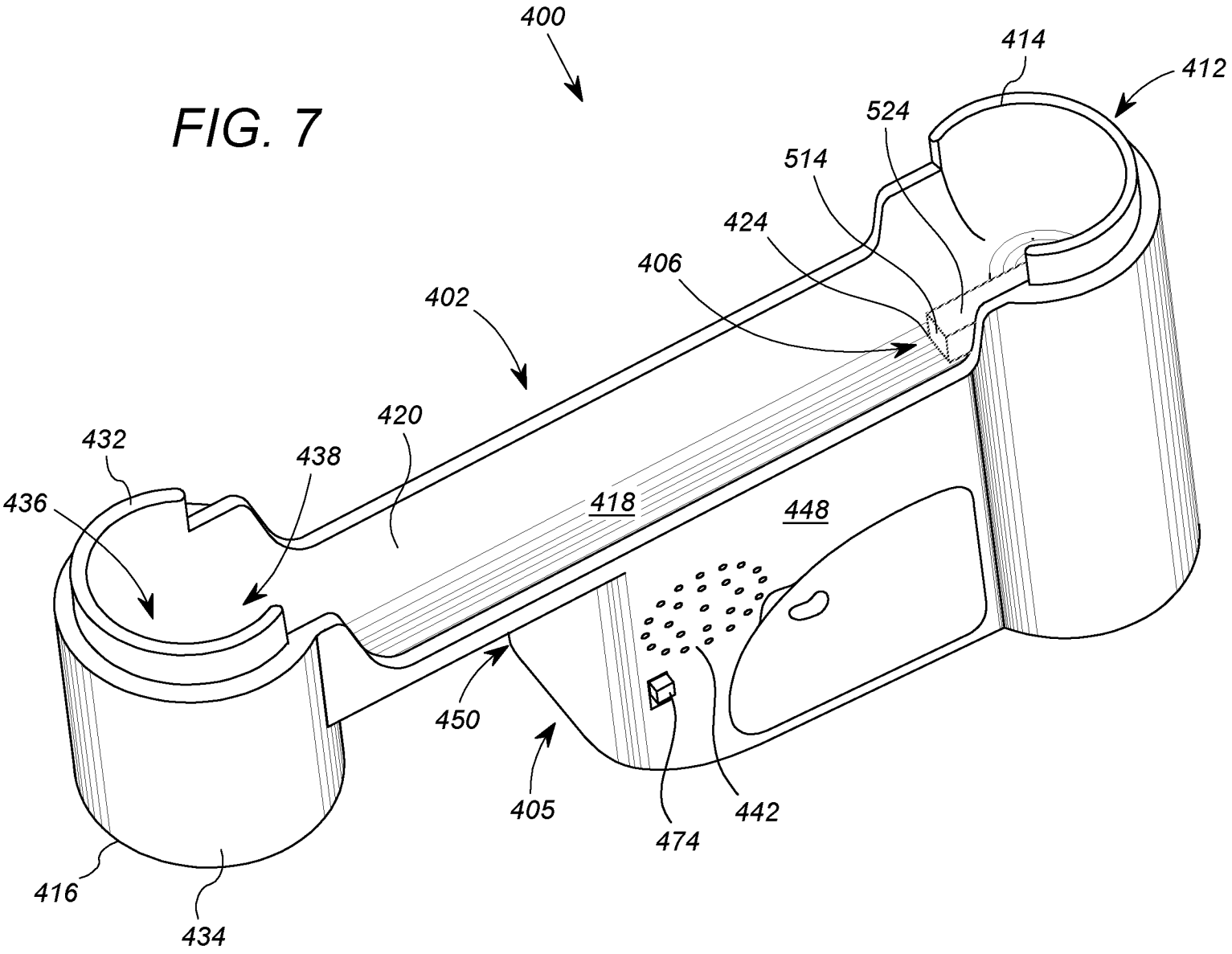
FIG. 7 shows a first perspective view of a second embodiment of a marble track module that may be employed in a marble run kit that also includes one or more modules shown in FIG. 1.
Figure 8:
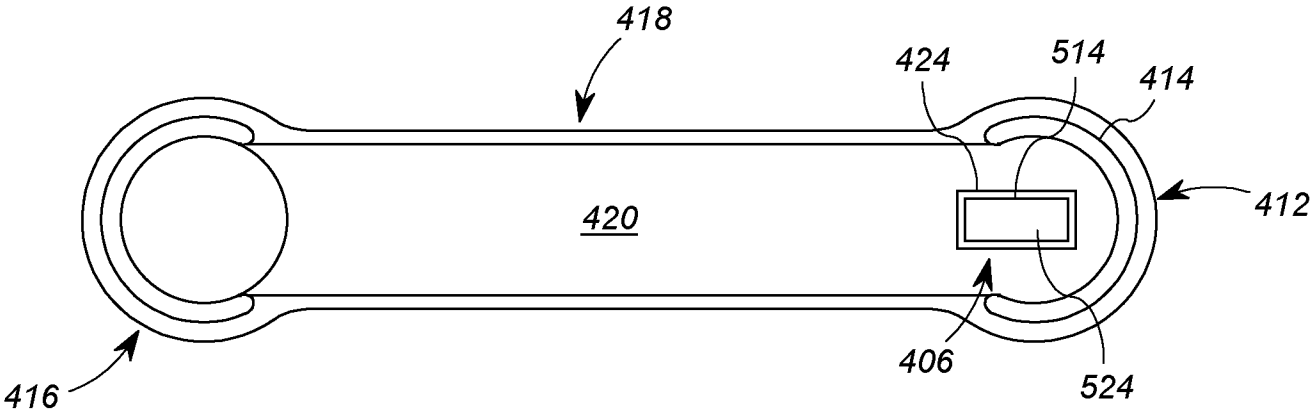
FIG. 8 shows a top plan view of the marble track module of FIG. 7.
Figure 9:
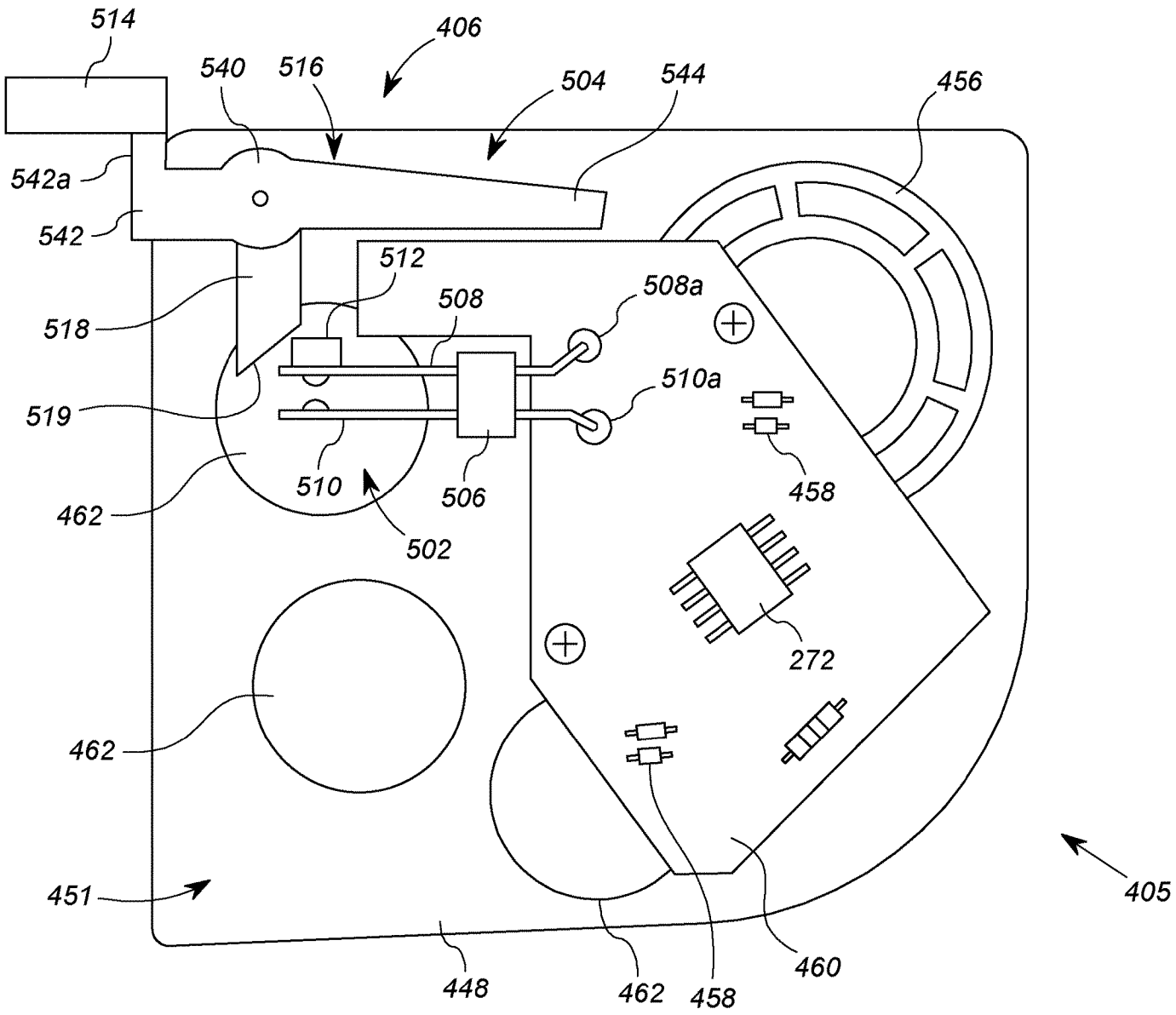
FIG. 9 shows a side plan view of a first side and interior of a housing of the module of FIG. 7 with a second side removed.

FIGS. 7, 8 and 9 illustrate an alternative embodiment of a triggered module 400 that is similar to the module 200 except that it implements an alternative switch 406 located in an alternative location, and has a different circuit board design. FIG. 7 shows a perspective view of the module 400 similar to the view of the module 200 in FIG. 2. FIG. 8 shows a top plan view of the module 400, and FIG. 9 shows a fragmentary view of the interior of the module housing 405.

Specifically, FIGS. 7 and 8 illustrate a second embodiment of an audio/visual marble track ("A/V") module 400 that may be used in a marble run kit according to the present invention. Like the A/V module 200 of FIGS. 1 to 5, the A/V module 400 includes a triggering arrangement that causes an A/V display responsive to a marble actuating the triggering mechanism.

To this end, the A/V module 400 includes an interconnectable track base 402, an output circuit 404, an assembly housing 405 and a marble actuated switch 406. The track base 402 includes a vertical receiving tube 412, an exit tube 416, and a travel region 418. The vertical receiving tube 412 includes a connecting portion 414 configured to directly physically connect to a corresponding exit tube of an upstream module. For example, the connecting portion 414 may suitably connect to any of the exit tubes 16 of FIG. 1. The vertical receiving tube 412 is configured to receive a suitable marble from the corresponding exit tube of the upstream module. The exit tube 416 of the module 400 is configured to directly physically connect to a corresponding vertical receiving tube of a downstream module. For example, the exit tube 416 is configured to connect to vertical receiving tube 14 of any of the modules 11 of FIG. 1.

The travel region 418 is in this embodiment a sloped, lateral, u-shaped marble channel configured to receive and guide a corresponding, suitable marble, similar to travel region 218. In general, the marble channel of the travel region 418 includes a marble receiving surface 420 and an opposite bottom surface 422. The travel region 418 is configured to retain and guide the marble from the vertical receiving tube 412 to the exit tube 416. The receiving surface 420 of the channel slopes downward from the receiving tube 412 to the exit tube 416 to allow the marble to advance at least in part via gravity. The travel region 418 and receiving surface 420 in this embodiment extend into and/or under the vertical receiving tube 412 to catch the marble falling into the receiving tube 412 and direct the marble down the travel region 418.

The marble actuated switch 406 is a spring biased contact switch disposed in and through an opening 424 in the marble receiving surface 420. As shown in FIG. 8, the marble actuated switch 406 is partially located within the vertical receiving tube 412. The marble actuated switch 406 has a first and a second position. FIG. 7 shows the switch 406 in a first position, in which at least a portion of the switch 406 (actuator button 514, discussed further below) stands proud of the marble receiving surface 420. In the second position, not shown, the switch 406 is depressed relative to the first position, and maybe, but need not be, flush with the marble receiving surface 420.

As will be discussed below in detail, the switch 406 is spring biased towards the first position, but is configured to depress to the second position responsive to the weight (and/or falling force) of a standard toy marble, not shown. Thus, when a marble rolls over the switch 406, it transitions the switch 406 from the first position to the second position. As will be discussed below, the transition of the switch 406 from the first position to the second position triggers an audio visual display. However, it will be appreciated that switch 406 may alternative be used to trigger transmission of an RF signal to cause an action somewhere away from the module 406.

The housing 405 is a container that is configured to support the output circuit 404. The output circuit 404 may suitably be identical in function and structure to the output circuit 204 of FIG. 6, or a suitable variant thereof. Likewise, the housing 405 may have a substantially identical structure as that of the housing 205. Accordingly, the housing 405 has a first side 448 and opposing second side 450 (not shown, but identical to side 250 of FIG. 4). In general, the housing 405 defines an interior 451 between the two opposing sides 448, 450.

Referring to FIG. 7, the first side 448 forms a cover, which in this embodiment also includes a wall with a rim (or raised edges) that align with and attaches to second side 450 to collectively define the interior 451 therebetween. As shown in FIG. 7, the first side 448 of the housing 405 may include a speaker grille 442 and access door 444, and a switch opening 446. The speaker grill 442 comprises a group of through-holes that extend from through the first side to the interior 451.

FIG. 9 shows perspective view of the first side 448 (or cover) of the housing 405 with the second side 450 removed, revealing the interior 451. Disposed within the interior 451 is the output circuit 404, including an integrated circuit (e.g. integrated circuit 272 of FIG. 6) a speaker 456, and two indicator lamps 458 in the form of light emitting diodes (LEDs). With reference to FIG. 7, the speaker 456 is disposed with its cone adjacent to and facing the speaker grill 442. The light emitting diodes 458 are disposed on a printed circuit board 460 that is mounted or at least supported by the first side 448. It will be appreciated that at least the second side 450 of the housing 405 is formed to be translucent or transparent, such that when the LEDs 458 are activated, light therefrom is visible through the second side 450.

The first side 448 also includes a plurality of battery housings 462 that are configured to receive and fit coin cell batteries. In this embodiment the first side 448 includes three battery housings 462 and three coin cell batteries, not visible. The battery housings 262 align with an access door similar to the access door 244 of FIG. 3, such that the batteries are disposed in the interior 251 adjacent to, and accessible by, the access door.

The printed circuit board 460 includes various electrical components, as well as conductive traces, not shown, for establishing the electrical connections discussed below above connection with FIG. 6.

Referring now to the switch 406 of FIG. 9, the switch 406 includes a spring contact assembly 502 and an actuator assembly 504. The spring contact assembly 502 includes a support pillar 506, a first conductive spring contact 508, a second conductive spring contact 510, and a spacer 512. The actuator assembly 504 is an integrally formed element that includes a button actuator 514, a rocker arm 516 and a drive pillar 518.

The rocker arm 516 includes a hub 540, an actuator arm 542, and a counterbalance arm 544. The hub 540 is pivotably mounted to housing 405, and has a horizontal axis of rotation in the conventional orientation of the module 400. The actuator arm 542 extends in a first direction from the hub 540, and includes a vertical portion 542*a* that extends upward (forming an L-shaped arm) to connect to and support the button actuator 514. The counterbalance arm 544 extends in a second direction from the hub 540 that is largely opposite to the first direction, the counterbalance arm 544 being sized and arranged to sufficiently counterbalance the actuator arm 542 and button actuator 514.

The drive pillar 518 is fixedly attached to, and extends vertically downward from, the rocker arm 516. In this embodiment, the drive pillar 518 extends vertically downward from the hub 540 of the rocker arm 516 but other arrangements are possible. The drive pillar 518 includes an angled bottom surface 519 configured to engage the spacer 512. The angled bottom surface 519 engages the spacer 512 such that the rotational movement of the rocker arm 516 and drive pillar 518 translates to vertical downward movement of the first conductive spring contact 508.

The button actuator 514 extends upward from the distal end of the rocker arm actuator arm 542 and terminates in a top surface 524. A portion of the button actuator 514 extends through the opening 424 of the travel region 418 to expose the surface 524 to marbles on the marble receiving surface 420. (See also FIGS. 7 and 8). The position of the button actuator 514 within the receiving tube 412 allows the falling impact of the marble to provide the force to actuator the switch 406, and also makes it less likely that the actuator 514 will impede the travel of the marble.

Referring to the contact assembly 502, the support pillar 506 extends vertically in the interior 451 and secures the first and second contacts 508, 510 in a vertically spaced manner. Each of the spring contacts 508, 510 is an elongate conductive metal spring element that extends in a cantilevered manner from the support pillar 506 in the lateral direction. Each of the spring contacts 508, 510 is electrically connected to, respectively, conductive terminals (or traces) 508*a*, 510*a* of the printed circuit board 460. In this embodiment, the circuit board 460 is arranged such that the contacts 508, 510 may be directly soldered to the printed circuit board 460.

When the spring contacts 508, 510 touch at the distal end, such as by operation of the rocker arm 516, the contacts 508, 510 complete an electrical connection between terminals 508*a* and 510*a*. The spacer 512 is disposed above the top of the spring contact 508.

The contacts 508, 510 are spring biased to be open circuited, as shown in FIG. 5. The spring bias pushes the spacer 512 upward against the bottom surface 519 of the drive pillar 518. That action holds the button actuator 514 and particular the top surface 524 above the marble receiving surface 420 of the travel region 418, as shown in FIG. 7. When a marble rolls over the button actuator 514, it forces the rocker arm 516 to rotate counter clockwise or downward. The slanted bottom surface 519 thus slides across the spacer 512 as it rotates, which in turn deflects the spring contact 508 downward toward the spring contact 510. The spring contact 508 touches the spring contact 510, thereby closing the switch connecting the points 508*a*, 510*a* on the printed circuit board 460. When the marble is clear of the button actuator 514, the spring bias of the spring element 508 (and 510, if necessary), causes the button actuator 514, to extend upward again to the resting position shown in FIGS. 7 and 9.

It will be appreciated that the use of the rocker arm, cantilevered spring elements and the sloped button element 514 allow for the marble to both pass the switch 406 without stopping, and yet generate enough force to close the switch 406.

The terminals 508*a*, 510*a* may suitably be connected to the output circuit 204 of FIG. 6 in the place of the terminals 308*a*, 310*a*. The terminals 508*a*, 510*a* perform the same function with respect to the output circuit 204 (or any alternative thereof) as the terminals 308*a*, 310*a*.

It will be appreciated that the above described embodiments are merely exemplary and that those of ordinary skill in the art may readily devise their own implementations and modifications that incorporate the principles of the present invention and fall within the spirit and scope thereof. It will be appreciated that the embodiment described above may be employed with only audio effects, or only visual effects. It will be appreciated that other quantities of LEDs may be used.

In other embodiments, the travel regions 218 and/or 418 may take other shapes that are capable of guiding a marble from a receiving tube to an exit tube. By way of non-limiting example, the travel regions 218/418 may take the shape of the marble travel regions between the receiving tubes 14 and exit tubes 16 of any of the modules 11A, 11B, 11C, 11D and 11E of FIG. 1. In such a case, a suitable location for the switch 206/406 may be found in any of such travel regions. It will also be appreciated that in other embodiments, the switches 206, 406 may be replaced by a switch that is mounted on the vertical receiving tube 214, 414 or exit tube 216, 416. However, in such a case, the housing 205, 405 may need to be moved to a different location, and the actuator may have to take a suitably different form.

In still other embodiments, the switch 206, 406 may be replaced with a wireless sensor, such as an infrared motion sensor, light sensor or the like.

What is claimed is:

1. A triggered marble run module for use with a plurality of physically interconnectable marble run modules, each module configured to retain a marble and guide the travel of the marble through the module on at least a first surface, the triggered marble run module comprising:

a marble travel path;

a marble actuated switch having a first terminal, and a second terminal, the marble actuated switch operably coupled to close a circuit between the first terminal and second terminal through the first terminal and the second terminal responsive to actuation by a marble traveling in proximity of the marble actuated switch; and an output circuit configured to generate at least one of a group consisting of an audio output, a visual output, and an RF signal output, responsive to formation of the closed circuit between the first terminal and the second terminal responsive to the actuation by the marble traveling in proximity to the marble actuated switch.

2. The triggered marble run module of claim 1, further comprising a speaker disposed below at least a portion of the marble travel path, wherein the output circuit includes a control circuit, an audio circuit, and a memory storing at least one audio signal, the control circuit configured to, responsive to the formation of the closed circuit, cause the audio circuit and speaker to generate the audio output based on in part on the at least one audio signal.

3. The triggered marble run module of claim 2, wherein the at least one audio signal comprises a plurality of audio signal sequences, and wherein the control circuit is further configured to, responsive to the formation of the closed circuit, cause the audio circuit and speaker to generate the audio output based on in part on a first audio signal sequence of the plurality of audio signal sequences.

4. The triggered marble run module of claim 3, wherein the control circuit is further configured to, responsive to a subsequent formation of the closed circuit, cause the audio circuit and speaker to generate a second audio output based on in part on a second audio signal sequence of the plurality of audio signal sequences.

5. The triggered marble run module of claim 4, further comprising at least one lamp, and wherein the control circuit is further configured to, responsive to formation of the closed circuit, cause illumination of the at least one lamp to provide at least a part of the visual output.

6. The triggered marble run module of claim 5, wherein the control circuit has logic configured to cause a predetermined sequence of light output signals to be provided to the at least one lamp to cause multiple illuminations of the at least one lamp as the visual output.

7. The triggered marble run module of claim 2, further comprising at least one lamp, and wherein the control circuit is further configured to, responsive to formation of the closed circuit, cause illumination of the at least one lamp to provide at least a part of the visual output.

8. The triggered marble run module of claim 7, wherein the control circuit has logic configured to cause a predetermined sequence of light output signals to be provided to the at least one lamp to cause multiple illuminations of the at least one lamp as the visual output.

9. The triggered marble run module of claim 1, further comprising at least one lamp disposed below at least a portion of the marble travel path, wherein the output circuit includes a control circuit, the control circuit configured to, responsive to formation of the closed circuit, cause illumination of the at least one lamp to provide at least a part of the visual output.

10. The triggered marble run module of claim 9, wherein the control circuit has logic configured to cause a predetermined sequence of light output signals to be provided to the at least one lamp to cause multiple illuminations of the at least one lamp as the visual output.

11. The triggered marble run module of claim 10, wherein the at least one lamp comprises a plurality of light emitting diodes.

12. The triggered marble run module of claim 1, wherein the marble travel path comprises:

a vertical receiving tube including a connecting portion configured to directly physically connect to a corresponding exit tube of an upstream marble run module, the vertical tube configured to receive the marble from the corresponding exit tube;

at least a first exit tube configured to directly physically connect to a corresponding vertical receiving tube of a downstream marble run module; and a travel region configured to retain and guide the marble from the vertical receiving tube to the exit tube; and a housing disposed below and affixed to the travel region, the housing supporting and containing the output circuit.

13. The triggered marble run module of claim 12, wherein the marble actuated switch includes an actuator operably coupled to be actuated by a marble located in the travel region.

14. The triggered marble run module of claim 13, wherein the travel region includes a marble receiving surface configured to receive and guide a marble, the marble receiving surface having an opening, and wherein the actuator is disposed within the opening.

15. The triggered marble run module of claim 1, wherein the marble travel path further comprises a vertical tube configured to couple to a first of the plurality of physically interconnectable marble run modules.

16. A triggered marble run module for use with a plurality of physically interconnectable marble run modules, each module configured to retain a marble and guide the travel of the marble through the module on at least a first surface, the triggered marble run module comprising:

a marble travel path;

a switch having an actuator disposed at least in part in the marble path, a conductive first spring element electrically coupled to a first terminal, and a conductive second spring element electrically coupled to a second terminal, the first spring element having a first bias in which the first spring element and the second spring element form an open circuit between the first terminal and the second terminal, the actuator operably coupled to cause the first spring element to overcome the first bias and form a closed circuit between the first terminal and the second terminal through the first and second spring elements.

17. The triggered marble run module of claim 16, wherein the marble travel path comprises:

a vertical receiving tube including a connecting portion configured to directly physically connect to a corresponding exit tube of an upstream marble run module, the vertical tube configured to receive the marble from the corresponding exit tube;

at least a first exit tube configured to directly physically connect to a corresponding vertical receiving tube of a downstream marble run module; and a travel region configured to retain and guide the marble from the vertical receiving tube to the exit tube.

18. The triggered marble run module of claim 17, wherein the actuator is operably coupled to be actuated by a marble located in the travel region.

19. The triggered marble run module of claim 17, wherein the travel region includes a marble receiving surface configured to receive and guide a marble, the marble receiving surface having an opening, and wherein the actuator is disposed within the opening.

20. The triggered marble run module of claim 16, wherein the switch further contains a counterweight arm rigidly coupled to the actuator, the actuator and counterweight arm operably connected to pivot with respect to the marble travel path such that when the marble engages the actuator, the actuator and counterweight arm pivot in a first direction, and when the actuator is disengaged, the actuator and counterweight arm pivot in a second direction.

* * * * *